US006632039B2

(12) United States Patent
Lin

(10) Patent No.: US 6,632,039 B2
(45) Date of Patent: Oct. 14, 2003

(54) KEYCAP ASSEMBLY

(75) Inventor: Winky Lin, Taipei (TW)

(73) Assignee: Silitek Corporation (TW)

( * ) Notice: Subject to any disclaimer, the term of this patent is extended or adjusted under 35 U.S.C. 154(b) by 0 days.

(21) Appl. No.: 09/908,122

(22) Filed: Jul. 18, 2001

(65) Prior Publication Data

US 2002/0064410 A1 May 30, 2002

(30) Foreign Application Priority Data

Nov. 28, 2000 (TW) ..... 89220659 U

(51) Int. Cl.[7] ..... B41J 5/08; B41J 5/10; B41J 5/12; B41J 5/14; B41J 5/25

(52) U.S. Cl. ..... 400/490; 400/492.1; 400/495

(58) Field of Search ..... 400/445.3, 448, 400/449, 446, 689, 495, 495.1, 488, 490, 496, 492.1; 200/344

(56) References Cited

U.S. PATENT DOCUMENTS

| | | | | | |
|---|---|---|---|---|---|
| 4,468,145 | A | * | 8/1984 | Denley | 400/696 |
| 4,771,146 | A | * | 9/1988 | Suzuki et al. | 200/340 |
| 5,350,244 | A | * | 9/1994 | Büttner | 400/496 |
| 6,022,157 | A | * | 2/2000 | Shih-Hung | 400/490 |
| 6,428,223 | B2 | * | 8/2002 | Chen | 400/495 |

* cited by examiner

*Primary Examiner*—Judy Nguyen
*Assistant Examiner*—Alfred Dudding
(74) *Attorney, Agent, or Firm*—Volpe and Koenig, P.C.

(57) ABSTRACT

A keycap assembly for using in a keyboard is provided. The keycap assembly includes a keycap having a lever fitting slot disposed in an inner wall thereof, and a lever having a curved portion in contact with the inner wall of the keycap for forming a downward slanting angle with respect to the inner wall of the keycap when the lever is assembled with the lever fitting slot of the keycap, thereby causing the keycap assembly to be assembled with the keyboard easily.

5 Claims, 8 Drawing Sheets

KEYCAP ASSEMBLY

FIELD OF THE INVENTION

The present invention relates to a keycap assembly, and more particularly to a keycap assembly for using in a keyboard.

BACKGROUND OF THE INVENTION

FIGS. 1(*a*)~(*e*) are schematic diagrams illustrating the typical assembling flow charts of a keycap assembly. Please refer to FIG. 1(*a*), a lever 2 is assembled with a lever fitting slot 11 disposed in an inner wall of a keycap 1, thereby forming a freely rotating pivot 21. The lever 2 can freely rotate around the pivot 21. Therefore, the keycap 1 should be inclined to form a inclined angle with respect to the surface of a keyboard 3 in order to insert the lever 2 into a sliding slot 32 of the keyboard 3 when the keycap 1 is assembled with the keyboard 3. There is a projection 31 on the entrance of the sliding slot 32 of the keyboard 3 to form a guiding slot 33 of the keyboard 3. The guiding slot 33 of the keyboard 3 makes the lever 2 easily insert into the sliding slot 32 of the keyboard 3. As shown in FIG. 1(*b*) and FIG. 1(*c*), the lever 2 is inserted into the guiding slot 33 of the keyboard 3 and the sliding slot 32 of the keyboard 3. As shown in FIG. 1(*d*), the keycap 1 is turned to a position for well connecting the keycap 1 and the keyboard 3. Please refer to FIG. 1(*e*), the keycap 1 is pressed down so as to finish the assembly. During the assembling process, the most important step is how to make the lever 2 be inserted into the sliding slot 32 of the keyboard 3. In the prior art, the lever 2 is assembled with the lever fitting slot 11 of the keyboard 3, thereby forming the freely rotating pivot 21. The lever 2 freely rotates around the pivot 21. Therefore, the disadvantage is that the lever 2 can not be held at a preset angle with respect to the inner wall of the keycap 1 to be inserted into the sliding slot of the keyboard 3 easily. Thus, the structure of the keycap assembly needs to be improved to overcome the above problem.

SUMMARY OF THE INVENTION

It is therefore an object of the present invention to propose a keycap assembly for using in a keyboard. The keycap assembly includes a keycap having a lever fitting slot disposed in an inner wall thereof, and a lever having a curved portion in contact with the inner wall of the keycap for forming a downward slanting angle with respect to the inner wall of the keycap when the lever is assembled with the lever fitting slot of the keycap, thereby causing the keycap assembly to be assembled with the keyboard easily.

According to an aspect of the present invention, the lever includes a first bar, two second bars, and two third bars. The first bar is formed in a C-shape having a first and a second holding end. Each of the two second bars has one end connected to the first and the second holding ends of the first bar respectively so as to form the curved portion of the lever. And each of the third bars has one end connected to the other end of a respective second bar, wherein the curved portion is in contact with the inner wall of the keycap for causing the lever to form a downward slanting angle with respect to the inner wall of the keycap when the lever is assembled with the lever fitting slot of the keycap.

In accordance with another aspect of the present invention, the lever includes a first bar, two second bars, and the third bars. The first bar has at least a protuberance for forming a curved portion. Each of the second bars has one end connected to a first end and a second end of the first bar respectively. And each of the third bars has one end connected to the other end of a respective second bar, wherein the curved portion is in contact with the inner wall of the keycap for causing the lever to form a downward slanting angel with respect to the inner wall of the keycap when the lever is assembled with the lever fitting slot of the keycap.

It is another object of the present invention to provide a lever adapted to be assembled with a keycap, wherein the keycap having a lever fitting slot disposed in an inner wall thereof. The lever includes a first bar, two second bars, and the third bars. The first bar is formed in a C-shape having a first and a second holding end. Each of the second bars has one end connected to the first and the second holding ends of the first bar respectively so as to form a curved portion of the lever. And each of the third bars has one end connected to the other end of a respective second bar, wherein the curved portion is in contact with the inner wall of the keycap for causing the lever to form a downward slanting angle with respect to the inner wall of the keycap when the lever is assembled with the lever fitting slot of the keycap.

It is another object of the present invention to provide a lever adapted to be assembled with a keycap, wherein the keycap has a lever fitting slot disposed in an inner wall thereof. The lever includes a first bar, two second bars, and two third bars. The first bar has at least one protuberance for forming a curved portion. Each of the second bars has one end connected to a first end and a second end of the first bar respectively. And each of the third bars has one end connected to the other end of a respective second bar, wherein the curved portion is in contact with the inner wall of the keycap for causing the lever to form a downward slanting angel with respect to the inner wall of the keycap when the lever is assembled with the lever fitting slot of the keycap.

The present invention may best be understood through the following description with reference to the accompanying drawings, in which:

BRIEF DESCRIPTION OF THE DRAWINGS

FIGS. 4(*b*), (*d*), and (*f*) are lateral views of different types of levers according to the present invention.

DETAILED DESCRIPTION OF THE PREFERRED EMBODIMENT

Figure 1A:
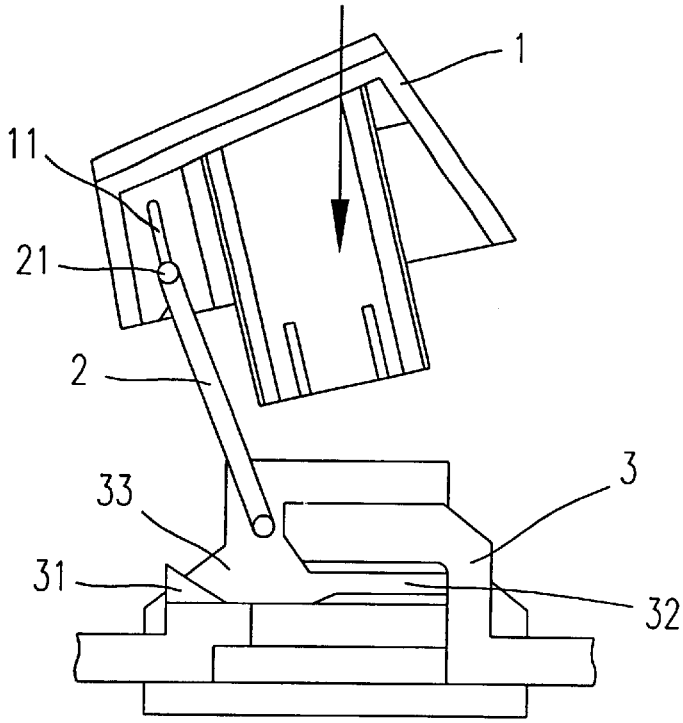
Fig. 1(a)(PRIOR ART)
FIGS. 1(*a*)~(*e*) are the typical assembling flow charts of a keycap assembly.
Figure 1B:
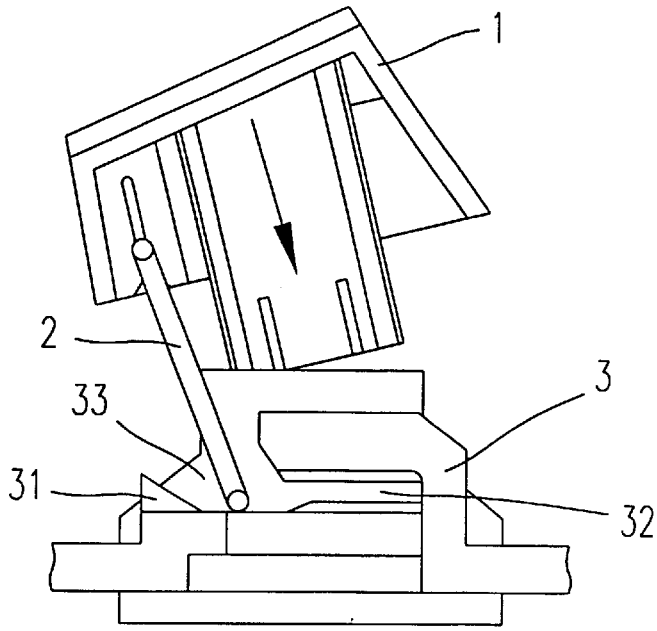
Fig. 1(b)(PRIOR ART)
Figure 1C:
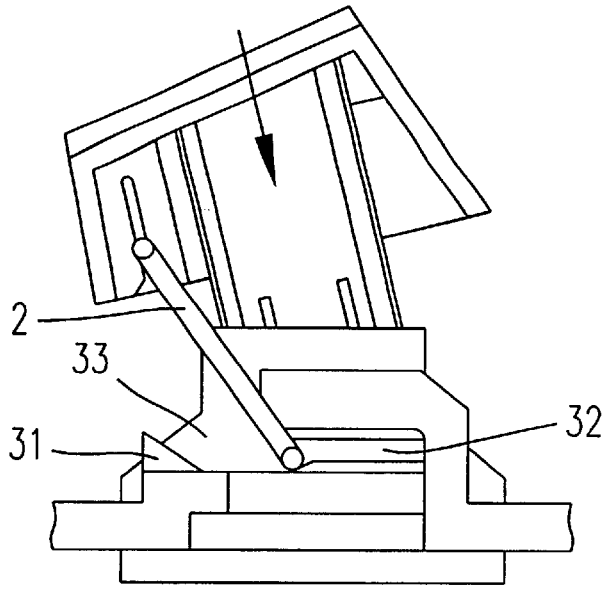
Fig. 1(c)(PRIOR ART)
Figure 1D:
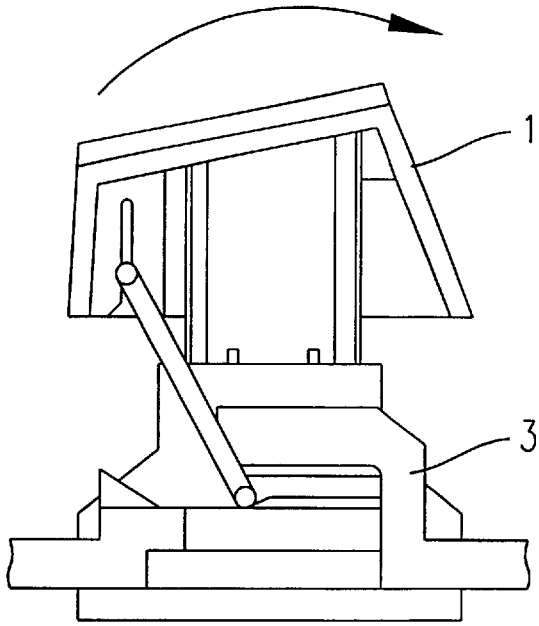
Fig. 1(d)(PRIOR ART)
Figure 1E:
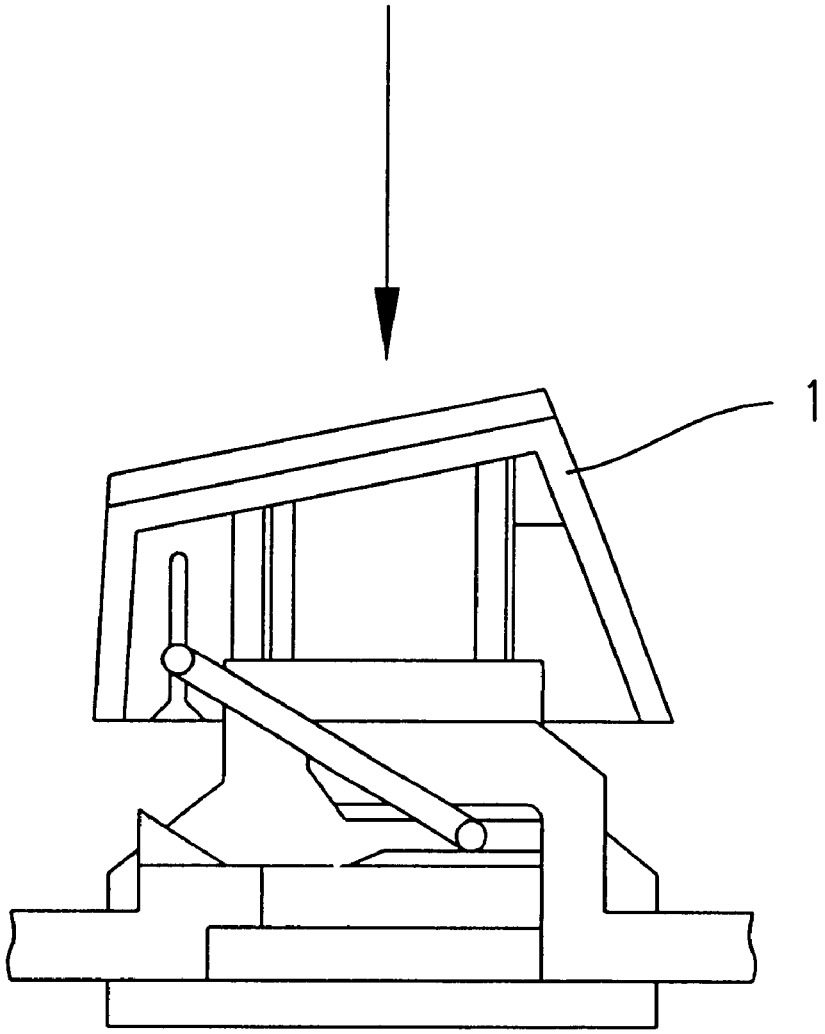
Fig. 1(e)(PRIOR ART)
Figure 2:
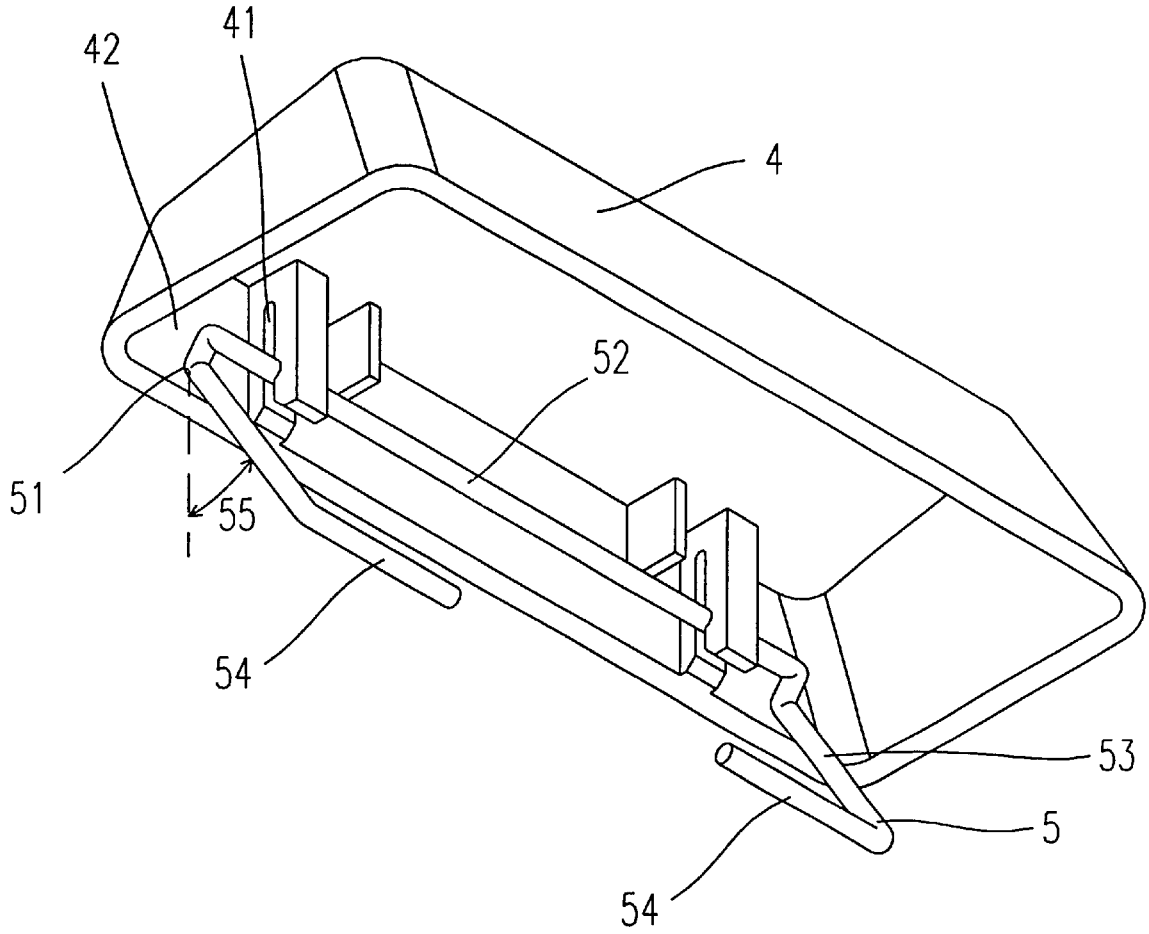
FIG. 2 is a schematic diagram illustrating a keycap assembly according to the preferred embodiment of the present invention.

FIG. 2 is a schematic diagram illustrating a keycap assembly according to the preferred embodiment of the present invention. Please refer to FIG. 2, the keycap assembly for using in a keyboard 9 (see FIG. 3) includes a keycap 4 having a lever fitting slot 41 disposed in an inner wall 42 thereof. And a lever 5 has a curved portion 51 in contact with the inner wall 42 of the keycap 4 for forming a downward slanting angle 55 with respect to the inner wall 42 of the keycap 4 when the lever 5 is assembled with the lever fitting slot 41 of the keycap 4, thereby causing the keycap assembly to be assembled with the keyboard 9 easily.

The lever 5 includes a first bar 52 being formed in a C-shape having a first and a second holding end. Each of two second bars 53 has one end connected to the first and the second holding ends of the first bar 52 respectively so as to form the curved portion 51 of the lever 5. And each of two third bars 54 has one end connected to the other end of a respective second bar 53, wherein the curved portion 51 is in contact with the inner wall 42 of the keycap 4 for causing the lever 5 to form a downward slanting angle 55 with respect to the inner wall 42 of the keycap 4 when the lever 5 is assembled with the lever fitting slot 41 of the keycap 4.

Figure 3A:
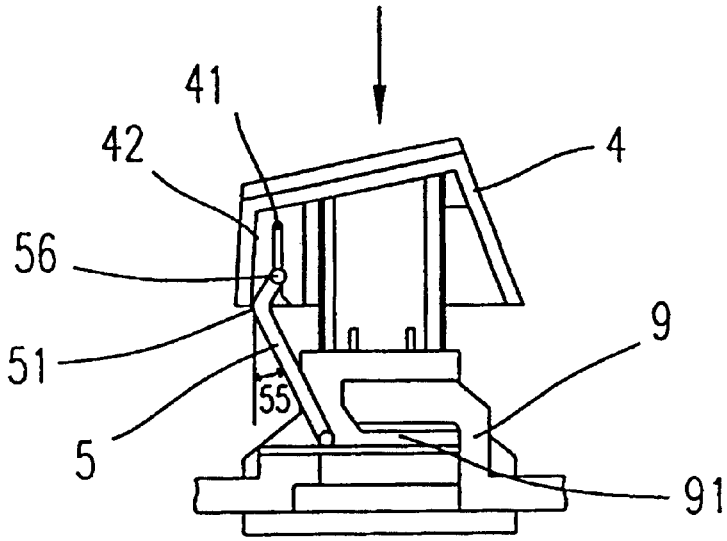
FIGS. 3(*a*)~(*b*) are assembling flow charts of a keycap assembly according to the preferred embodiment of the present invention.
Figure 3B:
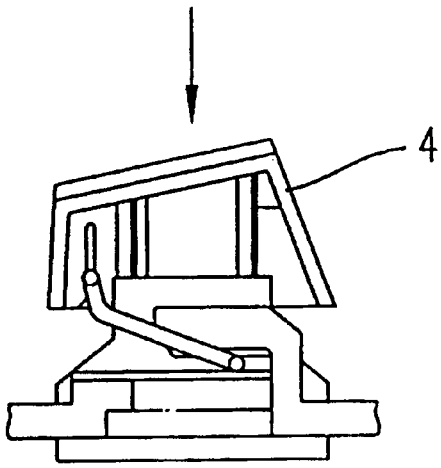
Figure 4A:
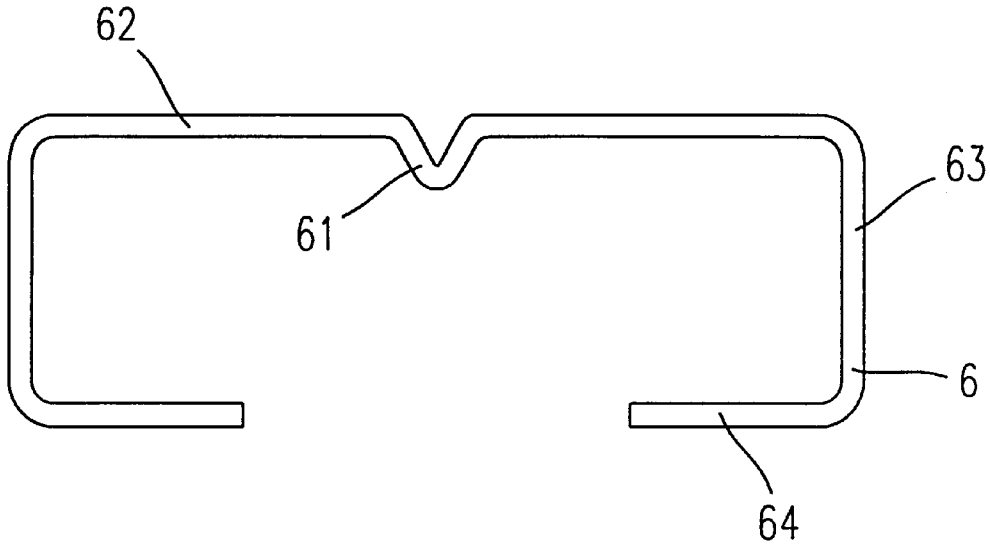
FIGS. 4(*a*), (*c*), and (*e*) are front views of different types of levers according to the present invention.
Figure 4B:
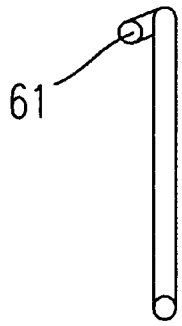
Figure 4C:
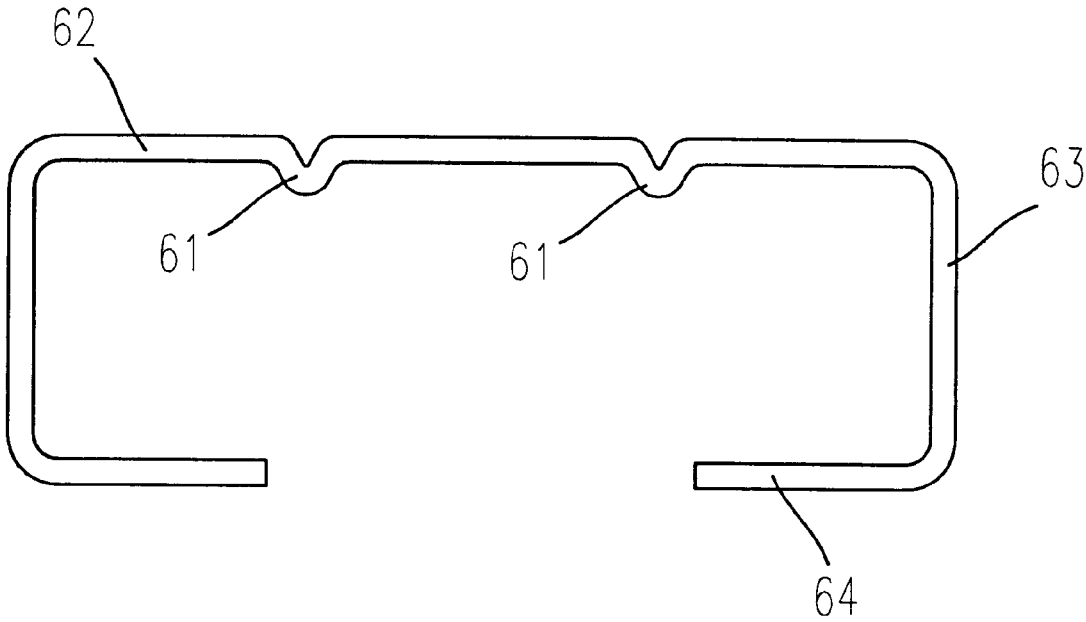
Figure 4D:
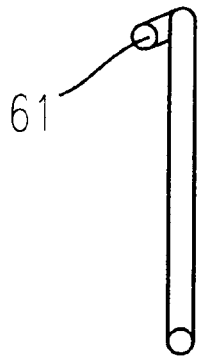
Figure 4E:
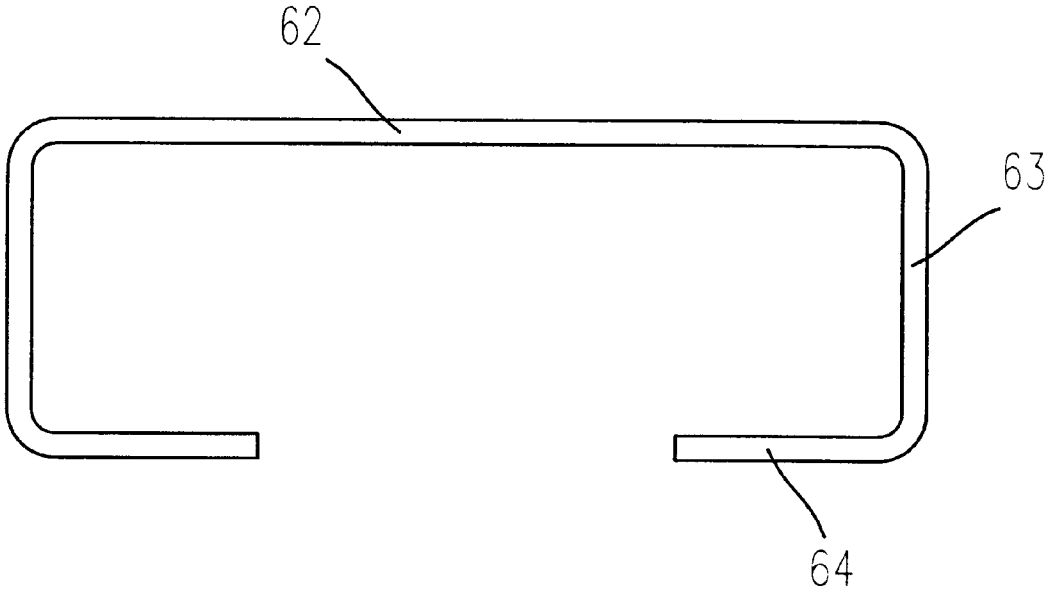
Figure 4F:
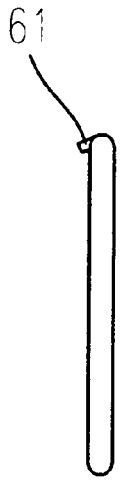

FIGS. 3(*a*)~(*b*) are schematic diagrams illustrating assembling flow charts of a keycap assembly. Please refer to the FIG. 3(*a*), a lever 5 is assembled with a lever fitting slot 41 disposed in an inner wall 42 of a keycap 4. The lever 5 has a curved portion 51 in contact with the inner wall 42 of the keycap 4 for forming a downward slanting angle 55 with respect to the inner wall 42 of the keycap 4 when the lever 5 is assembled with the lever fitting slot 41 of the keycap 4, thereby forming a rotating pivot 56. Therefore, the lever can be held at the downward slanting angle 55 with respect to the inner wall 42 of the keycap 4 to be inserted into the sliding slot 91 easily. The keycap 4 should not be inclined to form an inclined angle with respect to the surface of a keyboard 9 in order to insert the lever 5 into a sliding slot 91 when the keycap 4 is assembled with the keyboard 9. Please refer to the FIG. 3(*b*), the keycap 4 is pressed down so as to finish the assembly. Thus, the structure of the keycap assembly can be improved to overcome the problem of the prior art.

FIGS. 4(*a*), (*c*), and (*e*) are front views of different types of levers, and FIGS. 4(*b*), (*d*), and (*f*) are lateral views of these different types of levers respectively. Please refer to FIGS. 4(*a*), and (*b*). The lever 6 comprises a first bar 62 having at least one protuberance for forming the curved portion 61. Each of the two second bars 63 has one end connected to a first end and a second end of the first bar 62 respectively. And each of two third bars 64 has one end connected to the other end of a respective second bar 63, wherein the curved portion is in contact with the inner wall of the keycap for causing the lever 6 to form a downward slanting angel with respect to the inner wall of the keycap when the lever 6 is assembled with the lever fitting slot of the keycap. Certainly, the lever can be modified as shown in FIGS. 4(*c*)~(*f*).

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A keycap assembly for using a keyboard, comprising:

a keycap having a lever fitting slot disposed in an inner wall thereof; and a lever having upper and lower portions connected by a curved portion in contact with said inner wall of said keycap for forming a downward slanting angle of said lower portion with respect to said inner wall of said keycap when said lever is assembled with said lever fitting slot of said keycap, thereby causing said keycap assembly to be assembled with said keyboard easily.

2. The keycap assembly according to claim 1, wherein said lever comprises:

a first bar being formed in a C-shape having a first and a second holding end;

two second bars, each of which has one end connected to said first and said second holding ends of said first bar respectively so as to form said curved portion of said lever; and two third bars, each of which has one end connected to the other end of a respective second bar.

3. The keycap assembly according to claim 1, wherein said lever comprises:

a first bar having at least one protuberance for forming said curved portion;

two second bars, each of which has one end connected to a first end and a second end of said first bar respectively; and two third bars, each of which has one end connected to the other end of a respective second bar.

4. A lever adapted to be assembled with a keycap, wherein said keycap has a lever fitting slot disposed in an inner wall thereof, comprising:

a first bar being formed in a C-shape having a first and a second holding end;

two second bars, each of which has one end connected to said first and said second holding ends of said first bar respectively so as to form a curved portion of said lever; and two third bars, each of which has one end connected to the other end of a respective second bar;

wherein said curved portion is in contact with said inner wall of said keycap for causing said lever to form a downward slanting angle with respect to said inner wall of said keycap when said lever is assembled with said lever fitting slot of said keycap.

5. A lever adapted to be assembled with a keycap, wherein said keycap has a lever fitting slot disposed in an inner wall thereof, comprising:

a first bar having at least one protuberance for forming said curved portion;

two second bars, each of which has one end connected to a first end and a second end of said first bar respectively; and two third bars, each of which has one end connected to the other end of a respective second bar;

wherein said curved portion is in contact with said inner wall of said keycap for causing said lever to form a downward slanting angel with respect to said inner wall of said keycap when said lever is assembled with said lever fitting slot of said keycap.

* * * * *